US005481092A

United States Patent [19]

Westmeyer

[11] Patent Number: 5,481,092

[45] Date of Patent: Jan. 2, 1996

[54] MICROWAVE ENERGY GENERATION DEVICE USED TO FACILITATE REMOVAL OF CONCRETE FROM A METAL CONTAINER

[76] Inventor: Paul A. Westmeyer, 9012 Horton Rd., Laurel, Md. 20708

[21] Appl. No.: 353,357

[22] Filed: Dec. 2, 1994

[51] Int. Cl.[6] ..... H05B 6/80

[52] U.S. Cl. ..... 219/679; 219/748; 219/762; 219/695; 134/1

[58] Field of Search ..... 219/746, 748, 219/749, 762, 757, 679, 695, 738; 134/1

[56] References Cited

U.S. PATENT DOCUMENTS

| | | | |
|---|---|---|---|
| 2,859,952 | 11/1958 | La Tour et al. . | |
| 3,251,975 | 5/1966 | Hugenholtz . | |
| 3,261,959 | 7/1966 | Connell et al. . | |
| 3,300,253 | 1/1967 | Hylak . | |
| 3,307,010 | 2/1967 | Puschner . | |
| 3,430,021 | 2/1969 | Watson . | |
| 3,443,051 | 5/1969 | Puschner . | |
| 3,549,848 | 12/1970 | Williams | 219/762 |
| 3,601,448 | 8/1971 | Stone . | |
| 3,614,163 | 10/1971 | Anderson et al. . | |
| 3,727,982 | 4/1973 | Itoh et al. . | |
| 4,259,560 | 3/1981 | Rhodes . | |
| 4,319,856 | 3/1982 | Jeppson . | |
| 4,571,860 | 2/1986 | Long . | |
| 4,619,550 | 10/1986 | Jeppson . | |
| 4,743,725 | 5/1988 | Risman . | |
| 4,778,970 | 10/1988 | Klaila | 219/748 |
| 4,850,728 | 7/1989 | Arroyo | 15/105 |
| 4,881,819 | 11/1989 | Blees | 366/8 |
| 4,956,531 | 9/1990 | Braunisch et al. | 219/757 |
| 4,957,434 | 9/1990 | Radomsky . | |
| 5,003,144 | 3/1991 | Lindroth et al. . | |
| 5,244,498 | 9/1993 | Steinke | 134/34 |
| 5,303,999 | 4/1994 | Nath et al. . | |
| 5,322,367 | 6/1994 | Nath et al. . | |

*Primary Examiner*—Philip H. Leung
*Attorney, Agent, or Firm*—Cushman Darby & Cushman

[57] ABSTRACT

An apparatus for mixing concrete adapted to facilitate removal of hardened concrete therefrom includes a metal container and a microwave energy generation device. The metal container is adapted to contain concrete and to enable concrete placed therein to be mixed or agitated, the container having inner walls to which the concrete may adhere when the concrete hardens. The microwave energy generation device generates microwave radiation energy into the metal container and is capable of liberating water molecules from the concrete placed in the container so as to weaken the chemical structure of the concrete to thereby facilitate breakage of the hardened concrete and removal of the concrete from the container.

31 Claims, 6 Drawing Sheets

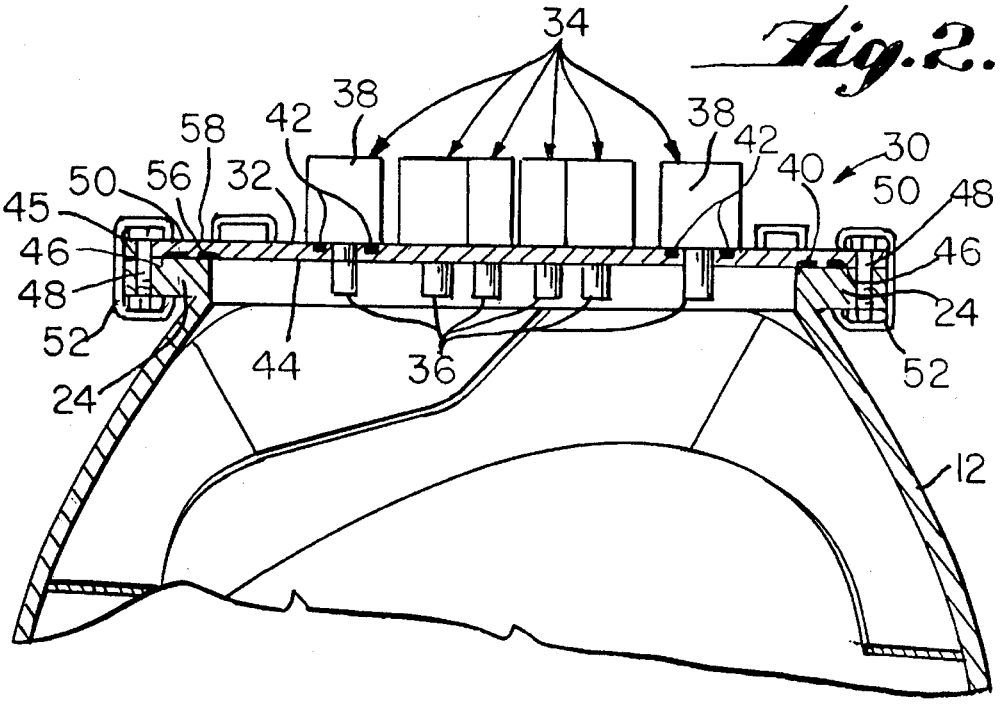
Fig. 2.
Fig. 3.
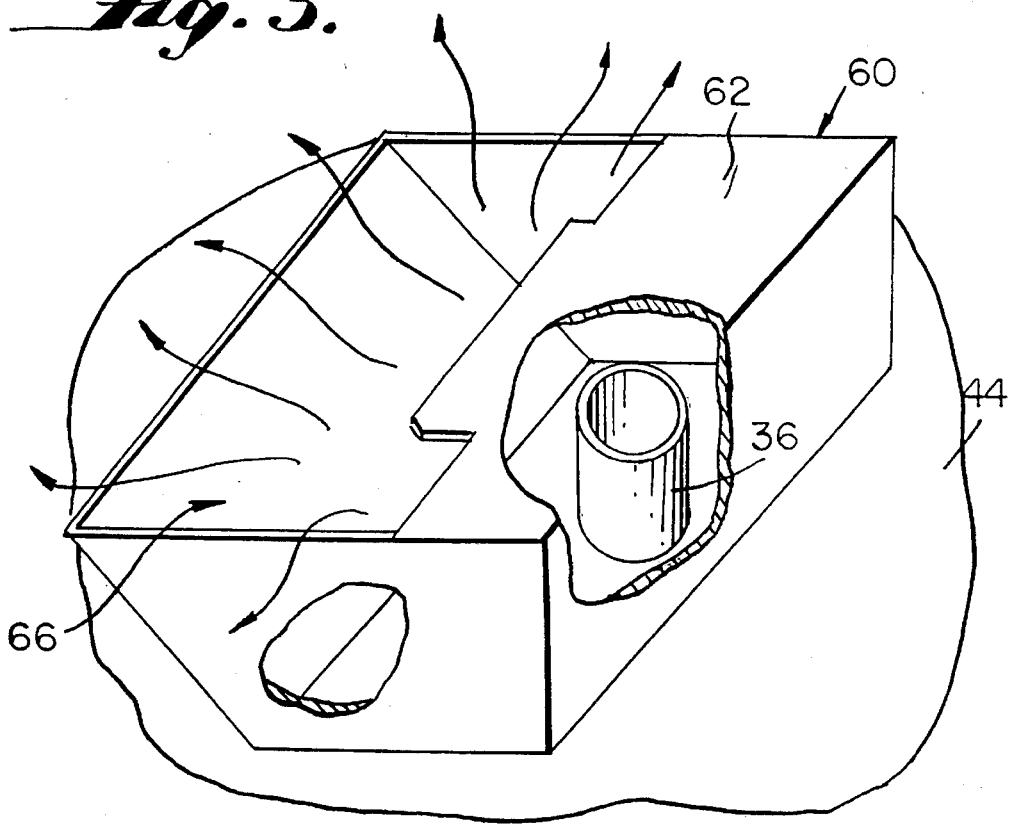

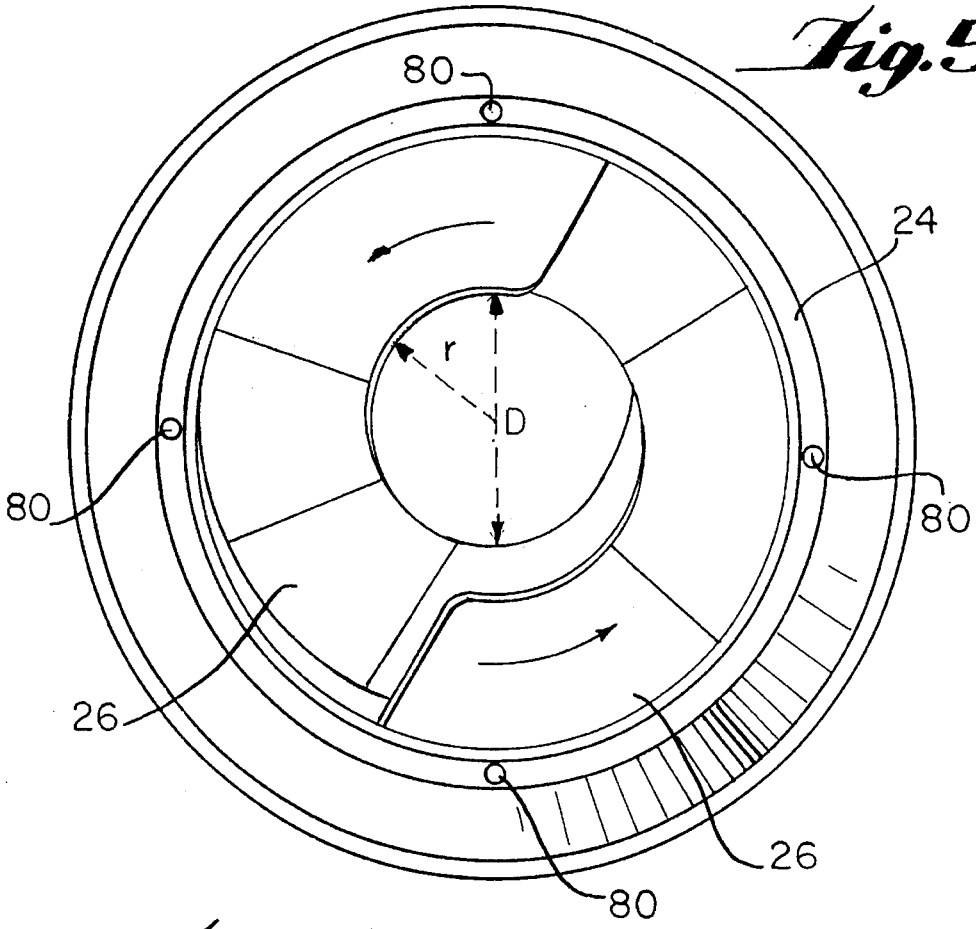
Fig. 5.
Fig. 4.
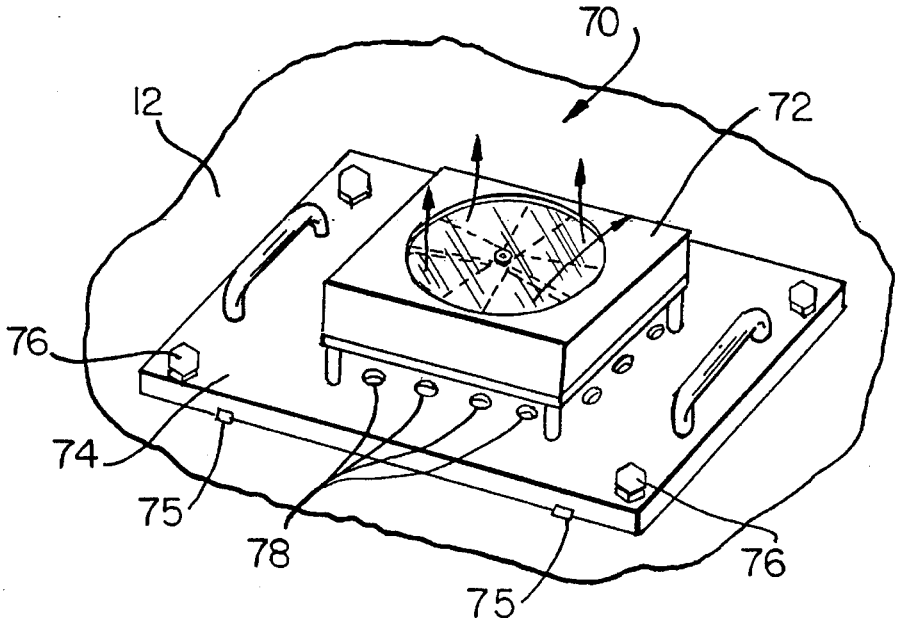

MICROWAVE ENERGY GENERATION DEVICE USED TO FACILITATE REMOVAL OF CONCRETE FROM A METAL CONTAINER

The present invention relates to devices used for removing concrete from concrete mixing containers and a method for removing concrete from such containers.

Containers for mixing concrete have their most predominant application in what are commonly known as "cement trucks," used in the construction industry. Such concrete mixing containers are typically made from metal, such as steel, and are mounted for rotation on a truck. The containers are provided with internal mixing fins for mixing or agitating concrete contained therein during rotation thereof. Such agitation and mixing maintains the consistency of the concrete and inhibits the concrete from hardening within the container.

Premixing containers or drums are also known in the concrete industry and are used to premix concrete (which is typically a mixture of cement, sand, stone, water and hardening agents) with rotatable blades mounted for rotation within the container. The premixing containers are also typically made from steel and have similar volumes to the cement truck type containers. Smaller concrete containers are also typically made from steel and serve, for example, as a household appliance for use in paving driveways and other similar applications. These smaller containers are also mounted for rotation or provided with other means of agitating concrete placed therein.

It can be appreciated that there are significant problems and costs associated with maintaining such mixing containers. For example, if a container containing concrete sits for an extended period of time without mixing or agitating the concrete contained therein, the concrete will harden or "cure." Most of the hardened concrete will adhere to the inner walls of the mixing container. Hardening of concrete within the container can be inhibited to some extent if the concrete within the container is continuously agitated until the container is emptied and cleaned with water or solvent. It can be appreciated, however, that it is quite difficult to prevent concrete from ever hardening within the container. In actual use, it is almost inevitable that some appreciable amount of hardened concrete will accumulate within the mixing container during its useful life. This build-up must be removed, or the mixer loses its efficiency and load carrying capacity. In fact, in some cases, an inordinate accumulation of concrete within the mixing container results in the need to dispose of the container. Disposal is normally a last resort, as containers of this nature are relatively expensive.

While different methods of removing hardened concrete from concrete mixing containers are currently employed, none are cost effective or convenient. The predominant method of concrete removal is for an individual to use a jackhammer, sledge hammer, or hammer and chisel, to mechanically break apart the concrete and then manually remove the concrete fragments from the container. In the instance in which it is necessary to remove hardened concrete from a large mixing container, such as those mounted on a cement truck, it is necessary for the individual to climb into the container and to mechanically break the hardened concrete while inside. In the instances in which large amounts of concrete must be removed, explosives may be used as a preliminary step in loosening the concrete.

While removal of concrete can be accomplished in such fashion, there are a number of drawbacks associated with it. For example, because of the inherent strength of hardened concrete, mechanical breakage is quite difficult, and requires a substantial number of man-hours when a typical amount of concrete must be removed. Additionally, because a substantial amount of force must be applied to the hardened concrete in order to break it apart (by explosion or by use of an appropriate tool), substantial damage to the container may be caused. For example, puncture holes or cracks can be formed in the container, thereby rendering it unusable. At this point, the container must either be discarded or repaired at a substantial expense.

The patent literature, such as U.S. Pat. Nos. 5,003,144, 3,443,051, 3,430,021, 3,614,163, and 3,601,448 has proposed to utilize microwave radiation energy to assist cracking of concrete or rock material in an open environment, such as in a rock field or on pavement. However, use of microwave energy in such fashion has had limited success. More specifically, in order to weaken the chemical structure of concrete sufficiently to facilitate breakage, it is necessary for microwaves to penetrate deeply into the concrete, and be absorbed by water molecules throughout the thickness of the concrete. In an open environment, microwaves must be projected at highly localized portions of concrete to enable any cracking of the concrete to be accomplished. For example, U.S. Pat. No. 3,4430,021, discloses the need to employ a microwave waveguide to direct a microwave beam at a small area of a concrete surface for a sufficient amount of time to cause localized cracking. Even with the application of microwave energy in such tedious fashion, the transmission losses of the microwave energy remain significant. As a result, the effectiveness and efficiency of these types of devices are lacking and commercially deficient.

The present invention stems from extensive experimentation in which microwave radiation energy was used to remove hardened concrete from the closed environment of a metal container. The experimentation revealed that generation of microwave energy into a metal container is an extremely effective and efficient way to separate concrete from the inner walls of the container and to make the concrete sufficiently brittle that it will crack. Because the container is made from metal, it effectively contains not only the concrete but also the microwave radiation energy. The metal fabric of the container will continue to reflect microwaves tuned to the natural resonant frequency of water molecules until the microwaves impact upon, and are absorbed by, water molecules in the concrete. The absorbed energy is released as thermal energy, and, eventually, the water molecules are liberated from the concrete as water vapor.

It has been found that operation of the microwave energy generation device of the present invention for a relatively short period of time (e.g., on the order of an hour, depending on the power of microwave energy generated and the amount of concrete which is to be removed), will cause a sufficient amount of water removal from the concrete to cause the concrete to become brittle and crack. In many areas, the concrete actually separates from the inner walls of the container. As a result, the force required to break apart the concrete is significantly reduced and can be applied relatively easily and quickly, without the likelihood of container damage. For example, an ordinary hammer or pry bar can be used to dislodge the concrete from the container walls. Even more significantly, it has been found that after applying microwave energy for a greater period of time (e.g., after a few hours), the hardened concrete will actually weaken sufficiently that it breaks free from the container wall at areas at which the adhesion forces no longer can support the weight of the concrete. Moreover, it has been found that application of microwave radiation energy for an even longer period of time (e.g., several hours) will actually cause the cement to explode into fragments. More specifically, as water vapor is liberated from the concrete, significant amounts of the vapor accumulates in small pockets within the concrete. As more water vapor is generated, the vapor pressure within the pockets increases. This, combined with the weakened chemical structure of the concrete, eventually causes the hardened concrete to explode. Thus, removal of hardened concrete can be accomplished simply be emptying the concrete fragments from the metal container, without the need for additional mechanical breakage, or for personnel to enter the confines of the container.

In one test, approximately one-half (½) yard (one yard of concrete is one cubic yard by volume) was removed from a commercial cement truck container. Approximately one cubic foot of the material was found broken free of the walls, some of which exploded free. Most of the remaining concrete had visibly separated from the mixing fins and walls of the container, and was sufficiently brittle that a two pound hammer and a twelve inch pry bar could be used to leverage the concrete from the fins and walls. In most areas, the separation space between the concrete and the inner surfaces of the container was large enough to insert the pry bar. In other areas, simple hammering caused the concrete to shatter and fall.

SUMMARY OF THE INVENTION

It is therefore an object of the present invention to provide an apparatus for mixing concrete that is adapted to facilitate removal of hardened concrete therefrom. The apparatus includes a metal container and a microwave energy generation device. The metal container is adapted to contain concrete to enable concrete placed therein to be mixed or agitated, the container having inner walls to which the concrete may adhere when the concrete hardens. The microwave energy generation device generates microwave radiation energy into the metal container and is capable of liberating water molecules from the concrete placed in the container so as to weaken the chemical structure of the concrete to thereby facilitate breakage of the hardened concrete and removal of the concrete from the container.

It is a further object of the present invention to provide a microwave energy generation device used to facilitate removal of concrete from a metal container utilized in mixing concrete. The microwave energy generation device includes a rigid base adapted to be mounted over an opening in the metal container, and at least one microwave energy generation source mounted on the base. The microwave energy generation source is capable of generating microwave radiation energy into the metal container to liberate water molecules from concrete in the metal container so as to weaken the chemical structure of the concrete. In addition, circuitry is operably connected with the at least one microwave energy generation source to enable the at least one microwave energy generation source to generate microwave energy.

In accordance with the principles of the present invention, it is a further object of the invention to provide a method for removing hardened concrete from a metal container. The method includes covering an opening in the metal container; generating microwave radiation energy into the metal container to liberate water molecules from the hardened concrete in the metal container so as to weaken the chemical structure of the concrete; uncovering the opening in the metal container; and removing the concrete from the metal container.

The preferred embodiment of the present invention will be better understood with reference to the following detailed description.

BRIEF DESCRIPTION OF THE DRAWINGS

FIG. 2 is a partial sectional view showing the interface between the microwave energy generation device and the metal container of the present invention.

FIG. 3 is a perspective view, with certain portions removed to better reveal others, of a shield structure in accordance with the principles of the present invention.

FIG. 4 is a perspective view showing a fan for drawing heated air with high water vapor content outwardly from the metal mixing-container in accordance with the principles of the present invention.

FIG. 5 is a plan view showing the main opening of the metal mixing-container of the present invention.

DETAILED DESCRIPTION OF THE PREFERRED EMBODIMENT

For convenience, the present invention is shown and described as it applies specifically to the type of metal mixing-container which is rotatably mounted on a cement truck. It is understood, however, that the present invention has applications in other types of metal mixing-containers for mixing concrete.

Figure 1:
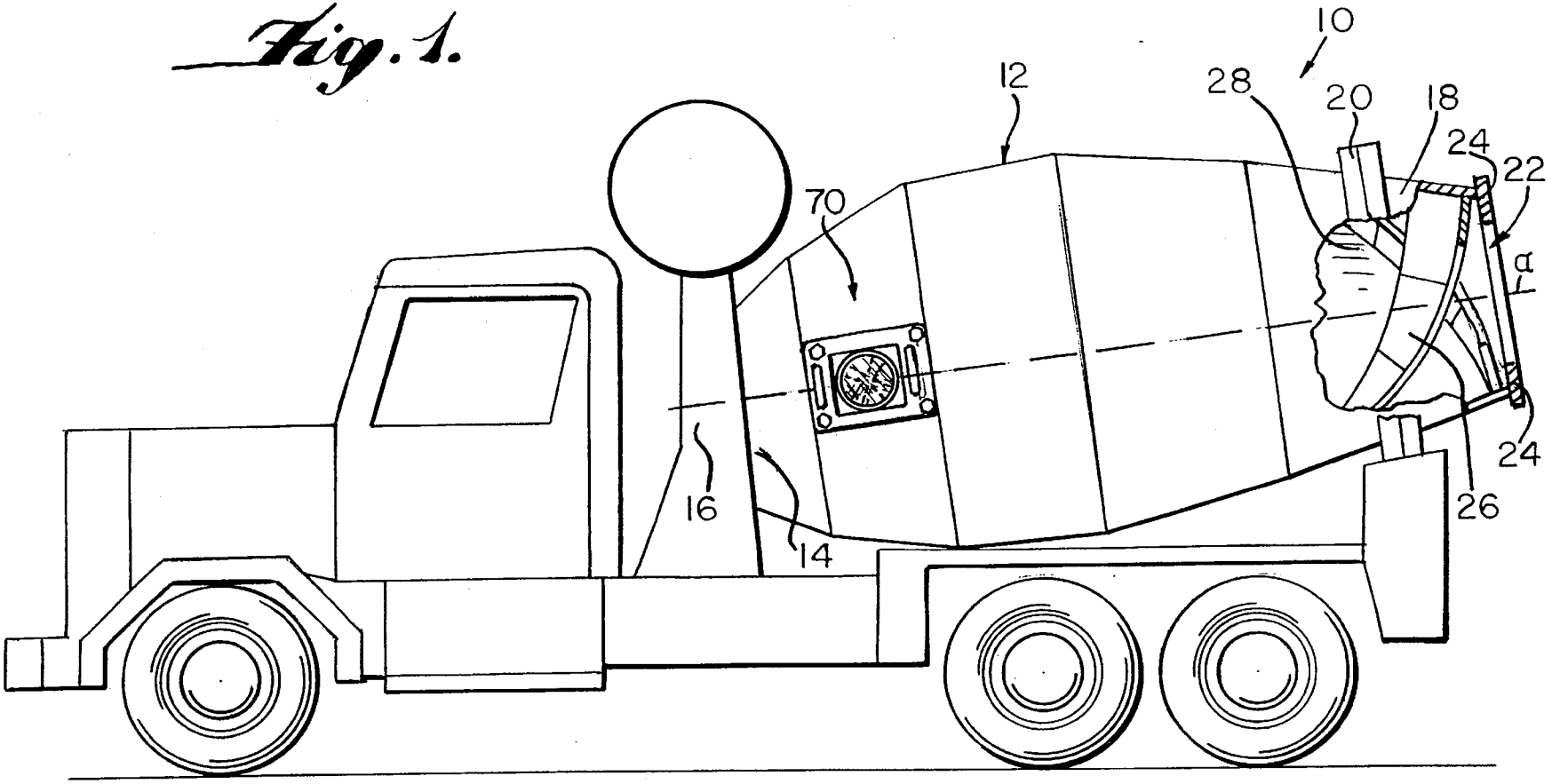
FIG. 1 is a schematic view, partly in section, showing a cement truck incorporating a metal mixing-container in accordance with the principles of the present invention.

Shown generally in FIG. 1 is a cement truck 10, which incorporates a metallic mixing-container 12 in accordance with the principles of the present invention. The metal container 12 has a forward end 14 thereof rotatably mounted on a rotating apparatus 16 of the truck 10. A rearward portion 18 of the container 12 is supported by a truck bearing mount 20, which facilitates rotation of the container through the rotating torque of apparatus 16.

The container 12 is somewhat tubular, and the rearward portion 18 thereof has a major opening, generally indicated at 22. The opening 22 is defined by an annular flange 24. While the forward end 14 is typically provided with a similar opening, such opening is closed off by its interface with the rotating apparatus 16.

It can be appreciated that the container 12 is adapted to have a concrete slurry, dry mix ingredients, or suspension placed therein through opening 22. As the mixing-container 12 is rotated via the apparatus 16, internal mixing fins 26 mix or agitate the concrete. The mixing fins 26 are welded to the inner surface 28 of the container 12, and extend radially inwardly into the container 12 toward the axis of rotation "a" indicated by dashed lines.

In FIG. 2, the interface between the metal container 12 and a microwave energy generation device, generally indicated at 30, is shown. The microwave energy generation device 30 includes a rigid base 32, made from a metallic material such as aluminum, and has a plate-like, circular configuration. The base 32 functions as a cover that closes off the major opening 22 in the container.

Figure 7:
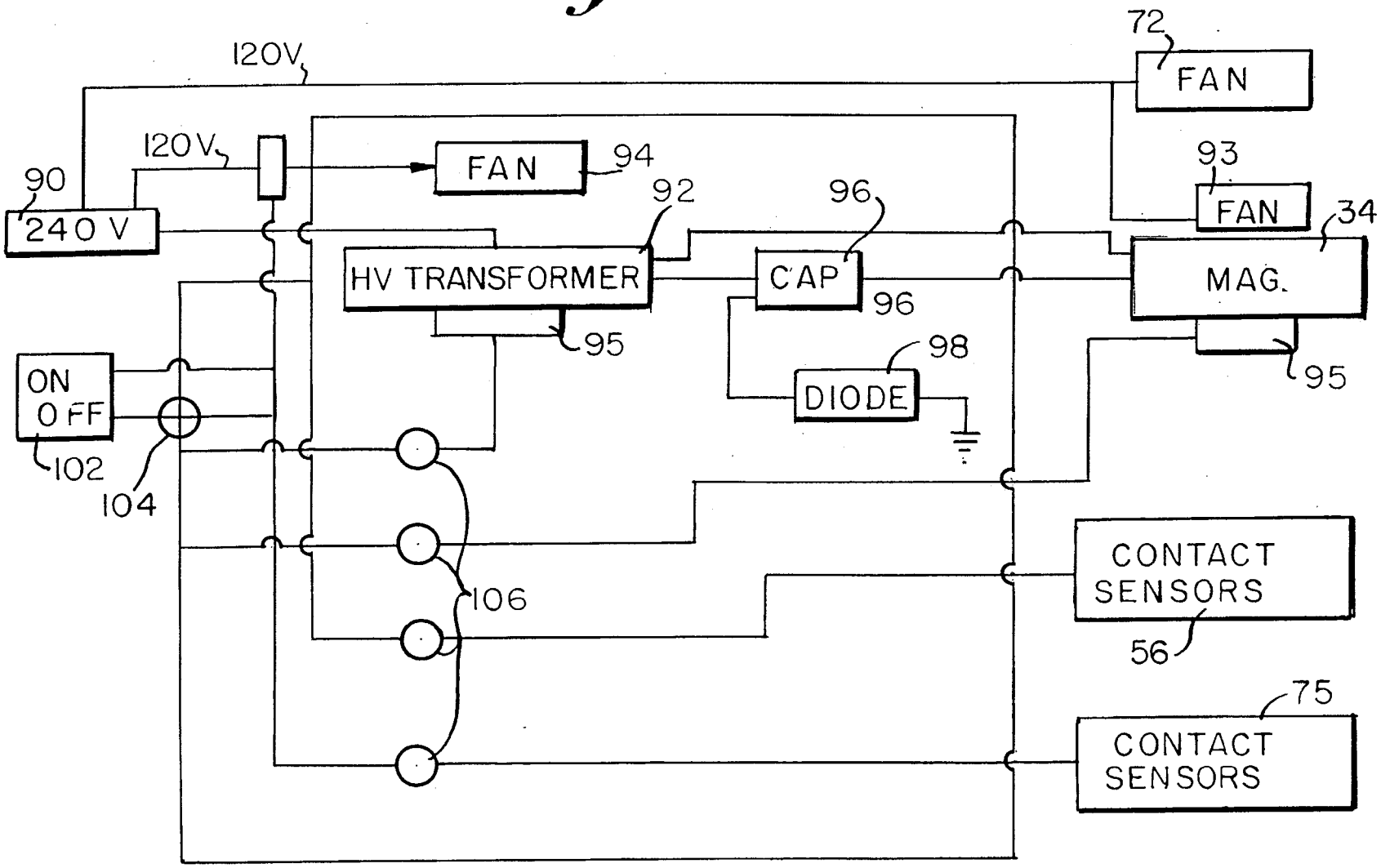
FIG. 7 is a block diagram showing the system used to operate the apparatus of the present invention.

The microwave energy generation device 30 also includes at least one microwave energy generation source mounted on the base. In FIG. 2, the microwave energy generation source is in the form of a plurality of magnetrons 34. The microwave energy generation device 30 also includes circuitry operably connected with the magnetrons 34, as is shown in FIG. 7, and which will be described in greater detail later.

The magnetrons 34 are commercially available, and each utilizes power in the 0.5–1 kilowatt range. Preferably, anywhere between fifteen to forty 1-kilowatt magnetrons are used, for a total of 15–40 kilowatts of power. It is understood that, as more power is used, the time required to evaporate a predetermined amount of water decreases. It is also understood that a single microwave energy generation source can be used. For example, it is possible to use a single magnetron of approximately 20 kilowatts. While a single magnetron with less power can also be used, the amount of time required to liberate the required amount of water will be longer than the time considered desirable for commercial application. It should also be noted that other types of microwave energy generation sources can be used, such as travelling wave tubes, klystrons, solid state amplifiers, and others. Preferably, the microwave generation source is tuned to a resonant frequency of the water molecule, which is approximately 2450 mHz. However, excitation of any molecular component, such that the bulk concrete rises in temperature beyond the boiling point of water, would provide an appropriate method for fracturing the concrete without using a water resonant frequency.

As shown in FIG. 2, each of the magnetrons 34 mounted on rigid base 32 includes an antenna 36 from which microwave energy is emitted, and a main housing 38. The housing 38 houses components used to generate the microwave energy. As shown, each of the main housings 38 are secured to an outer surface 40 of the rigid base 32 by appropriate fasteners 42. The antennas 36 extend through openings in the rigid base 32, past an inner surface 44 of the rigid base, and into the confines of the container. Omitted from FIG. 2, for clarity, are electrical cables and cooling fans for the magnetrons.

The annular flange 24 of container 12 engages an annular peripheral surface 46 of the rigid base 32, when the base 32 is mounted over the opening in the container 12. Fasteners 48 extend through the flange 24 and through openings 45 in the base 32 at circumferentially spaced locations to secure the base 32 to the container 12. Disposed between the flange 24 and annular surface 46 is an annular sealant 50. The sealant 50 is preferably in the form of a metal gasket, or a metallic resin. In addition to, or instead of, sealant 50, an exterior sealant 52 can be provided. Shown in FIG. 2, sealant 52 is in the form of metallic tape at the juncture between flange 24 and rigid base 32. The provision of such sealants is desirable in order to prevent leakage of microwave radiation into the environment.

During one seventeen hour test the microwave leak rate was measured at the interface of the annular flange 24 with the annular peripheral surface 46 of the rigid base 32. For sealant 52, metallic tape was used. C-shaped clamps were used as fasteners to peripherally secure the rigid base 32 to the annular flange 24. The measured leak rate was less than 1 milli-watt per centimeter squared (1 mw/cm$^2$).

Also provided between the container flange 24 and the annular surface 46 of the base, are contact sensors 56 mounted at circumferentially spaced positions on annular surface 46. The contact sensors 56 are connected with the circuitry shown in FIG. 7, and are operable to detect whether the annular surface 46 is in proper circumferential engagement with the annular flange 24. The contact sensors 56 serve as a precautionary measure, to ensure that microwave energy does not leak into the environment.

As also shown in FIG. 2, handles 58 are provided to enable a user to easily place the microwave energy generation device 30 over the opening in the container 12. In this regard, it is preferable for fasteners 48 to be captive bolts, which remain with the rigid base 32 at all times, and which can be easily aligned with the openings in flange 24.

Shown in FIG. 3 is a protective shield 60 manufactured in accordance with the principles of the present invention. The shield 60 is omitted from FIG. 2 for the sake of convenience. It is preferable for the protective shield 60 to be mounted on the inner surface 44 of the rigid base. The protective shield 60 has a protective wall 62 mounted directly over the antenna 36 in order to reduce the likelihood of exploding concrete fragments from impacting the antenna 36. The protective shield 60 is formed from a metallic material, and also functions to provide an impedance match for the antenna to free space. The shield 60 functions also to disperse the microwave energy through opening 66, after at least a portion of the microwaves are reflected within the confines of the shield 60. Such dispersion of microwaves is desirable because it reduces the time in which they will find and be absorbed by water molecules in concrete located in corners and crevices within the container.

It can be appreciated that providing a microwave energy generation device with a plate-like base is a preferred construction. The are other constructions which are also advantageous. For example, the microwave energy generation device may include an encasing mounting structure having an opening. Such an encasing mounting structure may have, for example, a cylindrical or box-like configuration. A cylindrical mounting structure would include a sleeve portion, one closed-off end, and one opened end mounted over the container 12 opening. The magnetrons would then be mounted on the exterior of the cylindrical encasing, with the antennas projecting inwardly into the confines of the encased area. By providing such a configuration, more mounting surface area is provided so that more magnetrons can be used. In other words, since the surface area of an encasing structure is larger than a plate-like base, more magnetrons can be mounted, thereby enabling more microwave energy to be generated. This expedites the liberation of water molecules from concrete.

Figure 8:
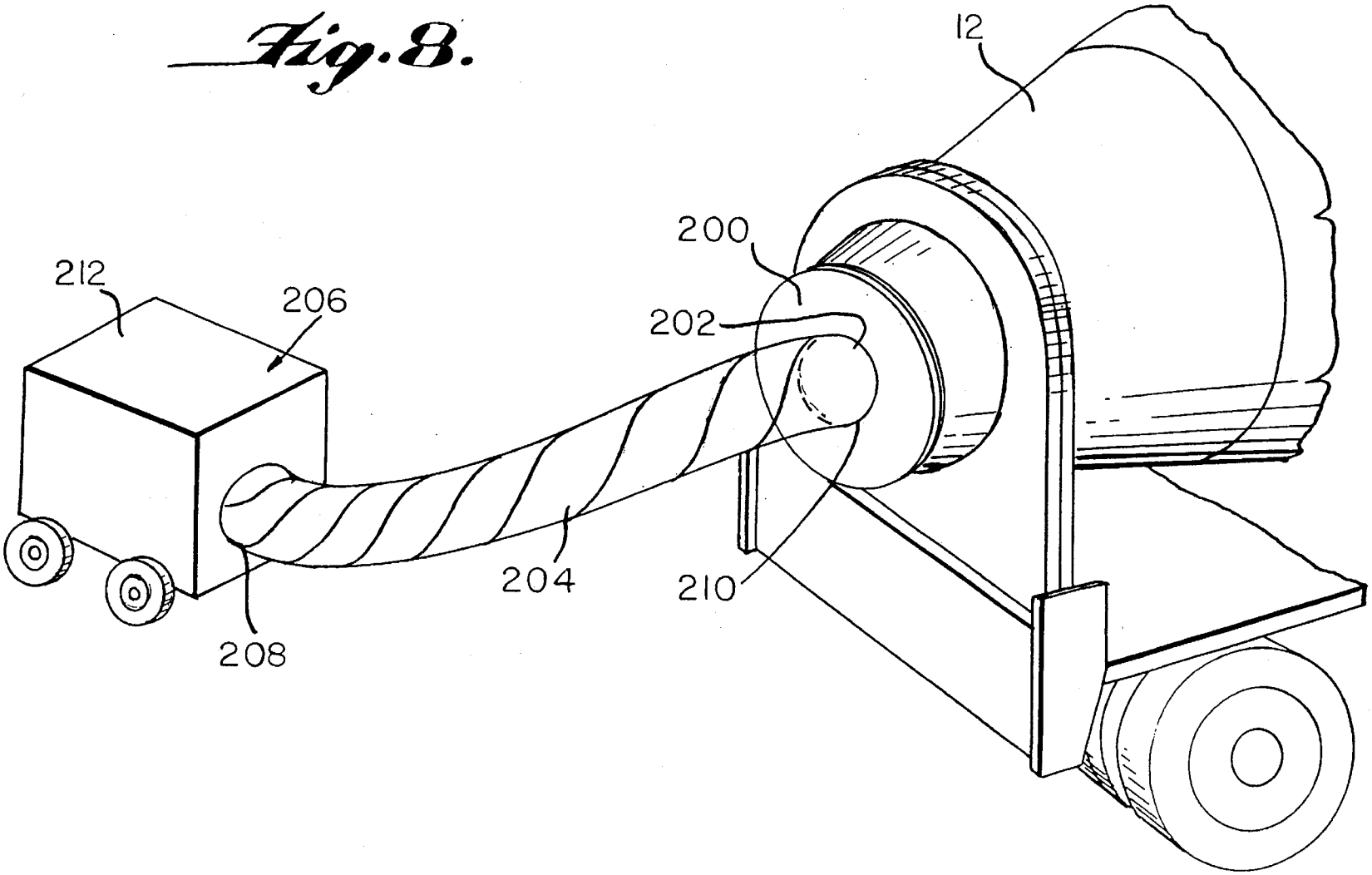
FIG. 8 is a perspective view showing another embodiment of the present invention.

In another configuration, as shown in FIG. 8, the microwave generation device includes a cover 200 for the container opening. While the cover may be similar to rigid base 32, it will not have any magnetrons mounted thereon. Rather, the cover 200 will be provided with one or more large openings 202 (only one opening being shown in the embodiment of FIG. 8) therethrough, each for receiving a metallic flexible tube 204. For example, the tube may be made from a corrugated aluminum, and have a diameter of approximately two to four feet. A microwave energy generation source 206, such as a plurality of magnetrons, is provided remotely from the cover. The microwave energy generation device may also include a mobile box 212 or enclosure into which the microwave energy is generated by the microwave energy generation source. In any event, the microwave energy is guided from the remote generation source by the metallic flexible tube 204 into the confines of the container. The tube is peripherally sealed at both ends 208 and 210 so that microwave energy cannot escape into the environment. This configuration is advantageous because no magnetrons are mounted on the cover, and as a result, the weight of the unit which is mounted over the container opening is greatly reduced. In addition, the circuitry and electrical cables that are connected with each magnetron (or other microwave generation source) can be harnessed more neatly. As a result, the apparatus can be made more user friendly.

FIG. 4 illustrates a ventilation device generally indicated at 70. The ventilation device is also shown in FIG. 1 mounted on the container 12. The ventilation device includes a fan 72 and a rigid metal plate 74. The plate 74 is secured over an opening in the side of the container 12 by appropriate fasteners 76. A sealant similar to the sealant 50 and/or 52 shown in FIG. 2 is used between the outer surface of the container about the side opening and the periphery of plate 74. Ventilation holes 78 extend through the plate 74, and enable the fan 72 to aspirate water vapor from the container as water is liberated from the hardened concrete by the microwave energy generation device. The plate 74 may be mounted over an opening within the container 12 which is normally provided to enable individuals cleaning the container 12 to climb into the container 12. When the container 12 is used to mix concrete, a plate similar to plate 74, but without ventilation holes, covers the side opening in the container.

It is preferable for vent holes 78 in the plate 74 to be sufficiently small, so that microwaves are not permitted to escape therethrough. For example, it is preferred that such openings be less than ¼" in diameter for a microwave frequency of 2450 mHz, since microwaves of this frequency have a wavelength of sufficient length, that they will not be permitted to traverse holes of this size.

Contact sensors 75 are preferably provided at spaced locations between the peripheral interface of the inner surface of the plate 74 and the exterior surface of the container 12. The contact sensors 75 are connected with the circuitry shown in FIG. 7, and are operable to provide an appropriate indication when proper peripheral contact between the plate 74 and the exterior surface of container 12 is not obtained. The contact sensors 75 are provided to warn a user of potential microwave leakage between the plate 74 and container 12.

FIG. 5 is a plan view showing the inner confines of container 12 as seen through opening 22. As shown, the peripheral flange 24 is provided with a plurality of openings 80, which serve to receive the fasteners 48 shown in FIG. 2. As can also be appreciated from FIG. 5, the fins 26 extend radially inwardly towards the axis of rotation of the container, and terminate a predetermined distance "r" therefrom. This distance "r" is shown by dashed lines in FIG. 5, and represents the radius of a circle generally defined by the inner edges of fins 26. The dashed line "D" represents the diameter of this circle.

Figure 6:
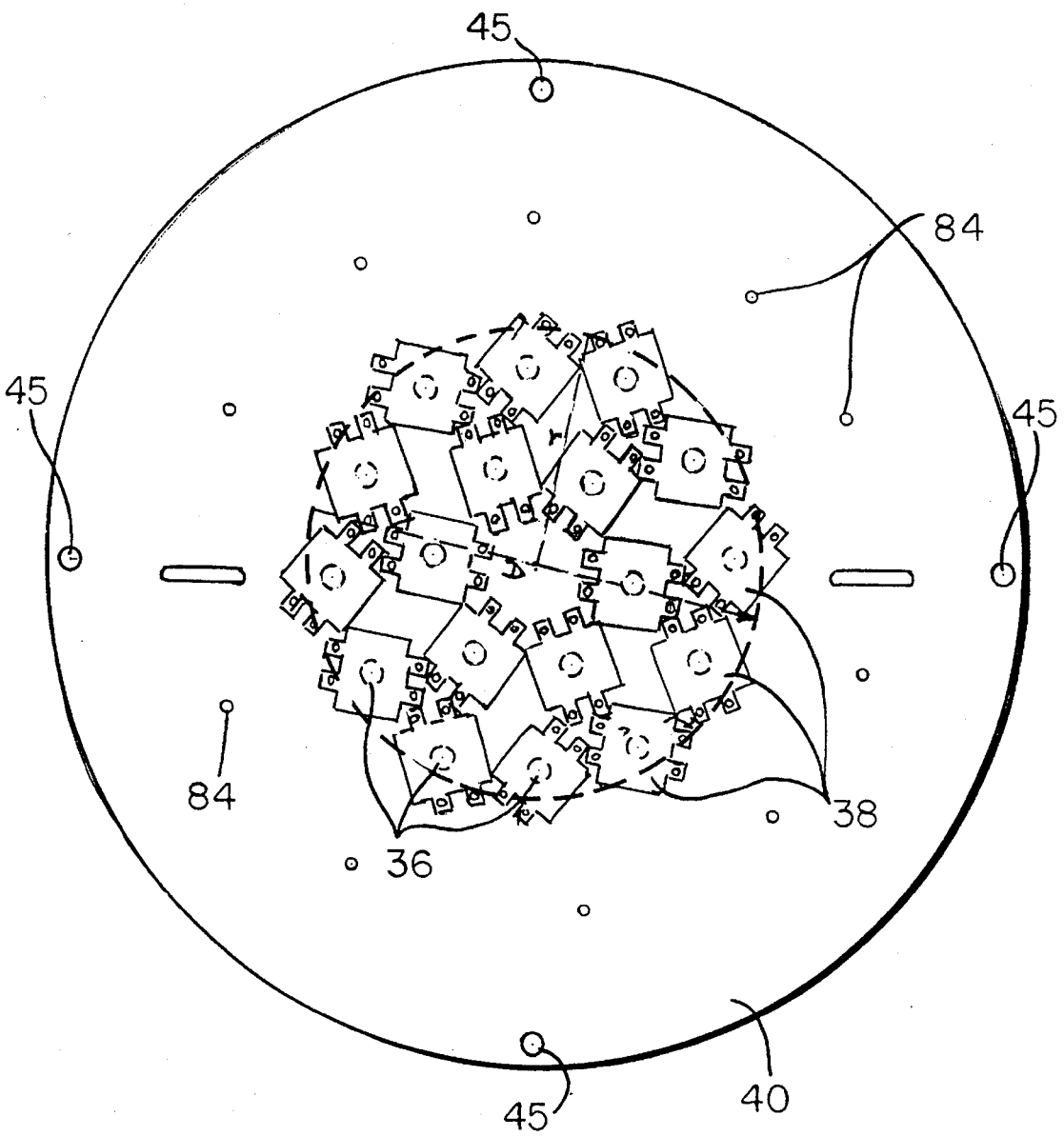
FIG. 6 is a plan view showing one side of the microwave energy generation device manufactured in accordance with the principles of the present invention.

FIG. 6 is a plan view of the microwave energy generating device 30 showing outer surface 40, and main housings 38. Not shown are wiring cables electrically connecting the magnetrons with appropriate circuitry, and forced air cooling fans for cooling the magnetrons. The antennas 36 of each of the magnetrons 34 are represented by circular dashed lines in FIG. 6. As also shown in FIGURE 6, vent holes 84 are provided at spaced locations through the rigid base 32. These vent holes permit outside air to enter the confines of the container 12 as air with high water vapor content is exhausted through vent holes 78 in the plate 74. The vent holes 84 provide cross-ventilation through the container and expedite the rate at which water molecules are forced from the container by fan 72. It is preferable for vent holes 84 in the rigid plate 32 to be sufficiently small so that microwaves are not permitted to escape therethrough. For example, it is preferred for such openings to be less than ¼" in diameter, as described hereinbefore with respect to openings 78 in plate 74.

As can also be discerned from FIG. 6, it is preferable for the majority of the magnetrons 34 to be concentrated towards the center of the rigid base 32, so that the antennas 36 are disposed within radius "r" from the center of the base. As noted hereinbefore, the circle formed by the inner edges of fins 26 defines radius "r" as shown in FIG. 5 The positioning of magnetrons 34 in this fashion decreases the time required for dispersion of microwaves towards the rearward portion of the container to facilitate liberation of water molecules from concrete thereat.

Shown in FIG. 7 is the circuitry forming part of the microwave energy generation device of the present invention. The circuitry includes a 240 VAC, 60 Hz voltage supply 90. The voltage supply 90 provides power for the entire apparatus, including the ventilation fan 72, high voltage/filament transformer 92, magnetrons 34, contact sensors 56, contact sensors 75, a fan 94 for cooling the transformer 92, and a fan 93 for cooling the magnetrons. Thermal cutouts 95 are used to protect the magnetrons and transformers. The circuitry also includes a capacitor 96 and diode 98. The diode, capacitor, and high voltage transformer function to provide electrical energy to the magnetrons 34, which convert the electrical energy to microwave energy. An on/off switch 102 is connected with a relay 104, and controls the operation of the microwave energy generation device 30. Indicator lights 106 are provided to indicate the proper functioning and/or status of the magnetrons 34, transformers 92, contact sensors 56, and contact sensor 75. For example, such indicator lights 106 might indicate whether power is being provided to each magnetron, and whether each of the contact sensors is making proper contact with the respective surface which it is to contact. It can also be appreciated that while only one on/off switch 102 may be provided, an independent switch may be provided for each magnetron. This may be beneficial, for example, when the same microwave energy generation device of the present invention is to be sequentially used in conjunction with many different containers of different sizes. With a larger sized container, it may be preferable to utilize more microwave radiation energy than with a smaller container.

With respect to the manner in which the microwave energy generation device is secured to the container, fasteners other than the bolts disclosed can be used. For example, the aforementioned C-shaped clamps may be used to clamp the peripheral outer portion of the rigid base 32 to the flange 24. Use of this type of clamp may facilitate the ability to adapt the microwave energy generation device to containers having flanges 24 of different diameters.

While premixing-containers typically have a major opening that is rectangular in shape, and which is generally larger that the opening in a container for a cement truck, the microwave generation device can be easily adapted by customizing the size and shape of the rigid base according to the size and shape of the opening over which it is to be mounted. The same holds true where the microwave generation device is to be used together with a smaller mixing-container.

While the invention has been illustrated and described in detail in the drawings and foregoing description, the same is to be considered as illustrative and not limiting in character. It is to be understood that the preferred embodiment has been shown and described and that all changes and modifications that come within the spirit and scope of the appended claims are to be protected.

What is claimed is:

1. A combination of a concrete mixing container and device for removing hardened concrete therefrom, comprising:

a metal container adapted to contain concrete, said metal container having inner walls and internal mixing fins connected to said inner walls, said internal mixing fins extending from said inner walls inwardly into said container for mixing or agitating concrete placed within said container, said inner walls and said mixing fins being prone to concrete rigidly adhering thereto when said concrete hardens; and a microwave energy generation device for generating microwave radiation energy into said metal container and being capable of liberating water molecules from said concrete placed in said container so as to weaken the chemical structure of said concrete to thereby facilitate breakage of said hardened concrete rigidly adhered to said inner walls and said mixing fins and thus removal of said concrete from said container.

2. The combination according to claim 1, wherein said microwave energy generation device comprises:

a rigid base for being mounted over an opening in said metal container;

at least one microwave energy generation source mounted on said base; and circuitry operably connected with said at least one microwave energy generation source to enable said at least one microwave energy generation source to generate microwave energy.

3. The combination according to claim 2, wherein said at least one microwave energy generation source comprises at least one magnetron mounted on said rigid base.

4. The combination according to claim 3, wherein each said magnetron includes an antenna from which said microwave energy is emitted, and further comprising a protective shield for protecting said antenna from concrete fragments within said container which may be projected toward said antenna as a result of the weakening of the chemical structure of said concrete.

5. The combination according to claim 4, wherein said protective shield is formed from metal and functions to disperse said microwave energy as it is emitted from said antenna.

6. The combination according to claim 3, wherein said rigid base has a plate-like configuration and is formed from a metallic material, said base having an inner surface facing inwardly into the confines of said container and an opposite surface facing outwardly from said container when said base is mounted over the opening in said container, and wherein each said magnetron comprises a main housing mounted on the opposite surface of said base, and an antenna extending from said main housing through an orifice in said base so as to project past said inner surface into said container when said rigid base is mounted on said container.

7. The combination according to claim 6, further comprising at least one handle mounted on said opposite surface.

8. The combination according to claim 3, wherein said container is adapted to be rotatably mounted on a truck, wherein an axis of rotation of said container generally passes through a central portion of said opening in said container, and wherein said internal mixing fins extend radially inwardly from said inner walls towards said axis.

9. The combination according to claim 8, wherein said mixing fins radially terminate at an inner edge disposed a predetermined distance from said axis, said at least one magnetron mounted on said rigid base being positioned at a distance from said axis which is generally less than or equal to said predetermined distance from said axis when said base is mounted over said opening in said container so that said microwave energy can be directed through said container without substantial interference from said fins.

10. The combination according to claim 8, wherein said container comprises a rearward opening disposed at a position opposite said opening over which said rigid base is mounted, said rearward opening adapted to be closed off by a portion of said truck on which said container is mounted.

11. The combination according to claim 2, wherein said metal container comprises an annular flange surrounding said opening therein, and wherein said rigid base has an annular surface constructed and arranged to engage said flange when said base is mounted over said opening.

12. The combination according to claim 11, further comprising fasteners for fastening said rigid base to said flange of said container with said annular surface of said rigid base disposed in contact with said flange.

13. The combination according to claim 12, further comprising a sealant disposed at a junction between said annular surface of said rigid base and said flange of said container to prevent microwave energy from escaping said container through said junction.

14. The combination according to claim 13, wherein said sealant comprises at least one of a metallic resin and a metallic gasket disposed between said annular surface and said flange.

15. The combination according to claim 13, wherein said sealant comprises metallic tape.

16. The combination according to claim 13, further comprising contact sensors disposed at circumferentially spaced positions on said annular surface, said contact sensors being operable to detect whether said annular surface is in circumferential engagement with said annular flange.

17. The combination according to claim 13, wherein said annular surface is disposed at an outer periphery of said rigid base.

18. The combination according to claim 2, further comprising at least one ventilation opening in at least one of said container and said rigid base, and a fan for forcing said water molecules liberated from said concrete through said at least one opening and outwardly from said container.

19. The combination according to claim 18, further comprising at least one cross-ventilation opening disposed in at least one of said container and said rigid base at a position spaced from said at least one ventilation opening to provide cross-ventilation facilitating said fan in forcing said water molecules from said container through said at least one ventilation opening.

20. The combination according to claim 19, wherein said at least one ventilation opening and said at least one cross-ventilation opening have a diameter less than a diameter that would permit microwave energy to escape said container therethrough.

21. The combination according to claim 20, wherein said diameter of said openings is less that ¼".

22. The combination according to claim 18, wherein said container comprises a removable panel having said at least one ventilation opening disposed therein, and wherein said fan is mounted on said removable panel of said container for forcing said water molecules through said at least one opening in said removable panel and outwardly from said container.

23. The combination according to claim 22, wherein a sealant is disposed between a peripheral portion of said removable panel and the exterior surface of said container to prohibit escape of microwave energy from said container.

24. The combination as claimed in claim 1, wherein said microwave energy generation device comprises:

a cover for being mounted over an opening in said metal container, said cover having at least one opening therethrough;

at least one microwave energy generation source disposed remotely from said cover; and at least one conduit providing communication between said microwave energy generation source and said at least one opening in said cover for transmitting microwave radiation energy from said at least one microwave energy generation source through said at least one opening and into said metal container.

25. A microwave energy generation device used to facilitate removal of concrete from a metal mixing container having an opening, said microwave energy generation device comprising:

a cover having an outer periphery larger than the opening in the metal mixing container to enable the cover to close said opening in said container, said cover having at least one opening therethrough;

a metal enclosure disposed remotely from said cover;

at least one microwave energy generation source contained within said metal enclosure remote from said cover and adapted to generate microwave radiation energy into the metal enclosure;

at least one conduit providing communication between said metal enclosure remote from said cover and said at least one opening in said cover for transmitting microwave radiation energy generated by said at least one microwave energy generation source through said at least one opening in said cover and into said metal container so as to liberate water molecules from hardened concrete within the metal container and thereby weaken the chemical structure of said hardend concrete; and circuitry operably connected with said at least one microwave energy generation source to enable said at least one microwave energy generation source to generate microwave energy.

26. A microwave energy generation device according to claim 25, wherein said cover is in the form of a metallic plate, and, and wherein said at least one conduit is made from aluminum.

27. A method of removing hardened concrete from a metal container used for mixing concrete comprising:

covering an opening in said metal container;

generating microwave radiation energy into said metal container to liberate water molecules from said hardened concrete in said metal container so as to weaken the chemical structure of said hardened concrete;

uncovering said opening in said metal container; and removing said hardened concrete from said metal container.

28. A method according to claim 27, further comprising generating sufficient microwave energy within said container to cause said hardened concrete to weaken to the extent that it fractures during generation of said microwave energy.

29. A method according to claim 27, further comprising mechanically breaking said weakened concrete after uncovering said opening in said metal container.

30. A method according to claim 27, wherein said hardened concrete is initially adhered to inner walls of said container, and further comprising separating said hardened concrete from said inner walls as a result of the generating of said microwave radiation energy into the metal container.

31. A method of using and cleaning a metal container used for mixing concrete in a cement truck comprising:

using said metal container to mix at least one batch of concrete slurry by rotating said metal container and causing mixing fins of said metal container to agitate said concrete slurry, at least a portion of said concrete slurry adhering to inner walls and said mixing fins of said metal container and becoming solidified on said inner walls and said mixing fins;

covering an opening in said metal container after a selected amount of said concrete slurry has solidified on said mixing fins of said metal container;

generating microwave radiation energy into said metal container to liberate water molecules from said solidified concrete in said metal container so as to weaken the chemical structure of said concrete and cause at least a portion of said solidified concrete to separate from said mixing fins;

uncovering said opening in said metal container; and removing at least a portion of said solidified concrete that has separated from said mixing fins from said metal container through said opening.

* * * * *

US005481092B1

REEXAMINATION CERTIFICATE (4218th)

United States Patent [19] [11] B1 5,481,092

Westmeyer [45] Certificate Issued Nov. 28, 2000

[54] MICROWAVE ENERGY GENERATION DEVICE USED TO FACILITATE REMOVAL OF CONCRETE FROM A METAL CONTAINER

[75] Inventor: Paul A. Westmeyer, Laurel, Md.

[73] Assignee: Martin Marietta Materials, Inc., Raleigh, N.C.

Reexamination Request:
No. 90/005,168, Nov. 19, 1998

Reexamination Certificate for:

| | |
|---|---|
| Patent No.: | **5,481,092** |
| Issued: | **Jan. 2, 1996** |
| Appl. No.: | **08/353,357** |
| Filed: | **Dec. 2, 1994** |

[51] Int. Cl.[7] ..... H05B 6/80

[52] U.S. Cl. ..... 219/679; 219/748; 219/762; 219/695; 219/737; 219/738; 134/1; 174/35 R

[58] Field of Search ..... 219/748, 746, 219/749, 762, 757, 679, 695, 738, 739, 741, 744, 752, 737; 134/1; 174/35 R, 35 GC, 35 MS

[56] References Cited

U.S. PATENT DOCUMENTS

| | | | |
|---|---|---|---|
| 2,859,952 | 11/1958 | La Tour et al. . | |
| 3,127,494 | 3/1964 | Kellough et al. | 219/748 |
| 3,251,975 | 5/1966 | Hugenholtz . | |
| 3,261,959 | 7/1966 | Connell et al. . | |
| 3,300,253 | 1/1967 | Hylak . | |
| 3,307,010 | 2/1967 | Puschner . | |
| 3,430,021 | 2/1969 | Watson . | |
| 3,443,051 | 5/1969 | Puschner . | |
| 3,549,848 | 12/1970 | Williams | 219/762 |
| 3,601,448 | 8/1971 | Stone . | |
| 3,614,163 | 10/1971 | Anderson et al. . | |
| 3,727,982 | 4/1973 | Itoh et al. . | |
| 4,046,983 | 9/1977 | Ishino et al. | 219/741 |
| 4,057,907 | 11/1977 | Rapino et al. | 34/4 |
| 4,252,487 | 2/1981 | Jeppson | 404/77 |
| 4,259,560 | 3/1981 | Rhodes . | |
| 4,319,856 | 3/1982 | Jeppson . | |
| 4,370,534 | 1/1983 | Brandon | 219/738 |
| 4,510,361 | 4/1985 | Mahan | 219/757 |
| 4,571,860 | 2/1986 | Long . | |
| 4,619,550 | 10/1986 | Jeppson . | |
| 4,743,725 | 5/1988 | Risman . | |
| 4,778,970 | 10/1988 | Klaila | 219/748 |
| 4,850,728 | 7/1989 | Arroyo | 15/105 |
| 4,881,819 | 11/1989 | Blees | 366/8 |
| 4,956,531 | 9/1990 | Braunisch et al. | 219/757 |
| 4,957,434 | 9/1990 | Radomsky . | |
| 5,003,144 | 3/1991 | Lindroth et al. . | |
| 5,244,498 | 9/1993 | Steinke | 134/34 |
| 5,303,999 | 4/1994 | Nath et al. . | |
| 5,322,367 | 6/1994 | Nath et al. . | |
| 5,429,799 | 7/1995 | Shieh et al. | 219/741 |
| 5,635,143 | 6/1997 | White et al. | 219/690 |

FOREIGN PATENT DOCUMENTS

| | | |
|---|---|---|
| 3-2595 | 1/1991 | Japan . |
| 5-16721 | 1/1993 | Japan . |

*Primary Examiner*—Philip H. Leung

[57] ABSTRACT

An apparatus for mixing concrete adapted to facilitate removal of hardened concrete therefrom includes a metal container and a microwave energy generation device. The metal container is adapted to contain concrete and to enable concrete placed therein to be mixed or agitated, the container having inner walls to which the concrete may adhere when the concrete hardens. The microwave energy generation device generates microwave radiation energy into the metal container and is capable of liberating water molecules from the concrete placed in the container so as to weaken the chemical structure of the concrete to thereby facilitate breakage of the hardened concrete and removal of the concrete from the container.

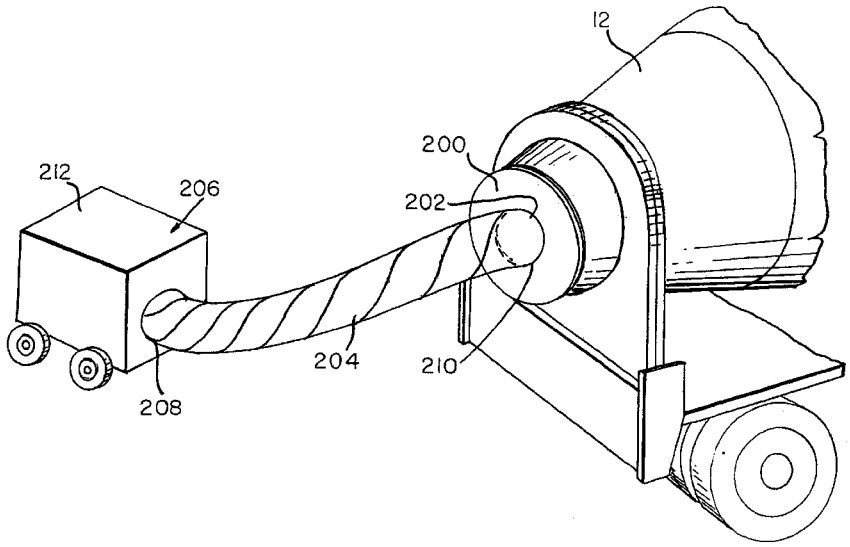

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5, 7, 9–10 and 21 is confirmed.

Claims 1–2, 11–13, 17–18 and 24–31 are cancelled.

Claims 3, 14–16, 19 and 22 are determined to be patentable as amended.

Claims 4, 6, 8, 20 and 23, dependent on an amended claim, are determined to be patentable.

New claims 32–34 are added and determined to be patentable.

3. The combination according to claim [2] *16*, wherein said at least one microwave energy generation source comprises at least one magnetron mounted on said rigid base.

14. The combination according to claim [13] *16*, wherein said sealant comprises at least one of a metallic resin and a metallic gasket disposed between said annular surface and said flange.

15. The combination according to claim [13] *16*, wherein said sealant comprises metallic tape.

16. [The] *A* combination [according to claim 13, further] *of a concrete mixing container and device for removing hardened concrete therefrom,* comprising*;*

*a metal container adapted to contain concrete, said metal container having inner walls and internal mixing fins connected to said inner walls, said internal mixing fins extending from said inner walls inwardly into said container for mixing or agitating concrete placed within said container, said inner walls and said mixing fins being prone to concrete rigidly adhering thereto when said concrete hardens;*

*a microwave energy generation device for generating microwave radiation energy into said metal container and being capable of liberating water molecules from said concrete placed in said container so as to weaken the chemical structure of said concrete to thereby facilitate breakage of said hardened concrete rigidly adhered to said inner walls and said mixing fins and thus removal of said concrete from said container, wherein,*

*said microwave energy generation device comprises*

*a rigid base for being mounted over an opening in said metal container,*

*at least one microwave energy generation source mounted on said base, and*

*circuitry operably connected with said at least one microwave energy generation source to enable said at least one microwave energy source to generate microwave energy,*

*said metal container comprises an annular flange surrounding said opening therein, and*

*said rigid base has an annular surface constructed and arranged to engage said flange when said base is mounted over said opening;*

*fasteners for fastening said rigid base to said flange of said container with said annular surface of said rigid base disposed on contact with said flange;*

*a sealant disposed at a junction between said annular surface of said rigid base and said flange of said container to prevent microwave energy from escaping said container through said junction; and* contact sensors disposed at circumferentially spaced positions on said annular surface, said contact sensors being operable to detect whether said annular surface is in circumferential engagement with said annular flange.

19. The combination according to claim [18] *22*, further comprising at least one cross-ventilation opening disposed in at least one of said container and said rigid base at a position spaced from said at least one ventilation opening to provide cross-ventilation facilitating said fan in forcing said water molecules from said container through said at least one ventilation opening.

22. [The] *A* combination [according to claim 18] *of a concrete mixing container and device for removing hardened concrete therefrom, comprising:*

*a metal container adapted to contain concrete, said metal container having inner walls and internal mixing fins connected to said inner walls, said internal mixing fins extending from said inner walls inwardly into said container for mixing or agitating concrete placed within said container, said inner walls and said mixing fins being prone to concrete rigidly adhering thereto when said concrete hardens;*

*a microwave energy generation device for generating microwave radiation energy into said metal container and being capable of liberating water molecules from said concrete placed in said container so as to weaken the chemical structure of said concrete to thereby facilitate breakage of said hardened concrete rigidly adhered to said inner walls and said mixing fins and thus removal of said concrete from said container, wherein,*

*said microwave energy generation device comprises*

*a rigid base for being mounted over an opening in said metal container,*

*at least one microwave energy generation source mounted on said base, and*

*circuitry operably connected with said at least one microwave energy generation source to enable said at least one microwave energy source to generate microwave energy; and*

*at least one ventilation opening in at least one of said container and said rigid base, and a fan for forcing said water molecules liberated from said concrete through said at least one ventilation opening and outwardly from said container*, wherein said container comprises a removable panel having said at least one ventilation opening *in at least said container* disposed therein, and

[wherein] said fan is mounted on said removable panel of said container for forcing said water molecules through said at least one *ventilation* opening in said removable panel and outwardly from said container.

*32. A combination of a concrete mixing container and device for removing hardened concrete therefrom, comprising:*

*a metal container adapted to contain concrete, said metal container having inner walls and internal mixing fins*

*connected to said inner walls inwardly into said container for mixing or agitating concrete placed within said container, said inner walls and said mixing fins being prone to concrete rigidly adhering thereto when said concrete hardens; and*

*a microwave energy generation device for generating microwave radiation energy into said metal container and being capable of liberating water molecules from said concrete placed in said container so as to weaken the chemical structure of said concrete to thereby facilitate breakage of said hardened concrete rigidly adhered to said inner walls and said mixing fins and thus removal of said concrete from said container, wherein*

*said microwave energy generation device comprises*

*a base for being mounted over an opening in said metal container, and*

*at least one microwave energy generation source in communication with said base;*

*said base has a plate-like configuration with an inner surface facing inwardly into the confines of said container and an opposite surface facing outwardly from said container when said base is mounted over the opening of said container;*

*said metal container comprises an annular flange surrounding said opening therein,*

*said base has an annular surface with contact sensors mounted at circumferentially spaced positions, said annular surface being constructed and arranged to engage said flange when said base is mounted over said opening; and*

*a sealant is disposed at a junction between said annular surface of said base and said flange of said container to prevent microwave energy from escaping said container through said junction.*

*33. The combination according to claim 32 wherein said microwave energy generation device has a power range of 20 kW to 40 kW.*

*34. The combination according to claim 32 wherein said microwave energy generation device is tuned to the resonant frequency of a water molecule.*

* * * * *